US005875255A

United States Patent [19]

Campbell

[11] Patent Number: 5,875,255

[45] Date of Patent: Feb. 23, 1999

[54] HIGH POWER ELECTROACOUSTIC SPEAKER SYSTEM HAVING WIDE BAND FREQUENCY RESPONSE

[76] Inventor: Paul G. Campbell, 18361 Burgess, Detroit, Mich. 48219

[21] Appl. No.: 919,842

[22] Filed: Aug. 28, 1997

[51] Int. Cl.[6] ..... H04R 25/00

[52] U.S. Cl. ..... 381/345; 381/349; 381/182; 181/199

[58] Field of Search ..... 381/87, 88, 89, 381/90, 158, 159, 182, 188, 205, 332, 345, 346, 347, 348, 353, 354, 186, 349; 181/144, 145, 147, 199

[56] References Cited

U.S. PATENT DOCUMENTS

| | | | |
|---|---|---|---|
| 4,146,744 | 3/1979 | Veranth | 181/156 |
| 4,224,469 | 9/1980 | Karson | 381/188 |
| 4,242,938 | 1/1981 | van Zalinge | 84/1.16 |
| 4,280,585 | 7/1981 | Nakanishi | 181/147 |
| 4,379,213 | 4/1983 | Lehnhardt | 179/115.5 R |
| 4,482,026 | 11/1984 | Stehlin, Jr. | 181/152 |
| 4,872,527 | 10/1989 | Han | 181/160 |
| 5,173,575 | 12/1992 | Furukawa | 381/159 |

FOREIGN PATENT DOCUMENTS

| | | | |
|---|---|---|---|
| 0336303 | 10/1989 | European Pat. Off. | 381/159 |

OTHER PUBLICATIONS

Abraham B. Cohen, Hi–Fi Loudspeakers and Enclosures, Rev. 2d Ed.,©1968 Hayden Book Company, Inc., pp. 290–297.

A. Badmaieff and D. Davis, Speaker Enclosures, Howard W. Sams & Co., New York ©1966.

*Primary Examiner*—Huyen Le
*Attorney, Agent, or Firm*—Brooks & Kushman P.C.

[57] ABSTRACT

A bass reflex-type loudspeaker having enhanced low frequency response and enhanced power handling capacity comprises a low frequency loudspeaker mounted in a ported enclosure whose walls are made purposefully resonant, the front baffle and rear surface of the enclosure connected by a sound post which serves to acoustically couple the front and rear enclosure surfaces.

13 Claims, 2 Drawing Sheets

HIGH POWER ELECTROACOUSTIC SPEAKER SYSTEM HAVING WIDE BAND FREQUENCY RESPONSE

TECHNOLOGICAL FIELD

The present invention pertains to electroacoustic speaker systems wherein at least one electrodynamic low frequency loudspeaker is contained within a speaker enclosure.

DESCRIPTION OF THE RELATED ART

Shortly after the introduction of the electrodynamic loudspeaker, it was recognized that for extended bass response, the acoustic energy generated from the back of the speaker would have to be isolated from that of the front. If not, destructive interference would occur between the soundwave generated by the back of the loudspeaker cone and the front at various frequencies, producing either holes in the frequency response or virtually eliminating the speaker response all together. Thus, if mounted on a simple baffle board, the board must be of enormous dimensions so as to prevent destructive interference at low frequencies.

Electrodynamic loudspeakers have a fixed resonant frequency at which they are most efficient; for "woofers", this resonant frequency is in the very low bass range. Low frequency loudspeakers must also have a compliant suspension in order to allow for significant speaker cone movement to allow reasonable acoustic power at low frequencies. The combination of low resonant frequency and low compliance suspension results in an underdamped condition when a loudspeaker is simply mounted on a baffle board, or even in the walls of a room where the back radiation and front radiation cannot contact each other. In this condition of underdamped oscillation, frequency response is not optimal, and high levels of distortion are present. Moreover, the frequency response generally rolls off below the resonant frequency at a rate of about 12 dB per octave.

Numerous means of countering these drawbacks of low frequency electrodynamic loudspeakers have been developed over the past decades. In the 1930's and 40's, for example, the backs of the low frequency transducer were mounted in relatively small, rigid, airtight cabinets, while the speaker fronts were coupled (through a low frequency filter) to a long folded exponential horn. The resultant speakers had excellent frequency response, low distortion, and very high efficiency. However, the length of the folded horn, from 16 to 32 feet in most cases, resulted in an exceptionally large cabinet which is very expensive to construct due to the many corners and angles present within it. A commercial embodiment of such a folded horn was the famous "Klipschorn" which is believed to still be available in the marketplace. Due to the fact that many people do not have the economic resources to purchase such a horn, nor the space to place two of these horns for stereo reproduction, a drive towards producing smaller loudspeaker enclosures while maintaining low frequency response and freedom from distortion quickly developed.

The result of one such development is the so called "bass-reflex" loudspeaker system. In such systems, the bass loudspeaker (woofer) is mounted in a tightly sealed cabinet having thick and non-resonant walls, in the face of which is located an opening communicating with the enclosure interior. The opening, in concert with the interior volume of the loudspeaker enclosure, forms a Helmholz resonator which, when tuned to the proper frequency, results in significant acoustic energy being directed out of the port. This acoustic energy is obtained from the back radiation of the loudspeaker, but because of the nature of the enclosure resonance, exits from the front of the enclosure in phase rather than out of phase with the front speaker radiation, despite, in many cases, being physically close to the woofer itself. As a result, the radiation efficiency of the speaker as a whole is markedly increased. In theory, the acoustic efficiency (acoustic power output/electrical power input), can be double that of a woofer mounted on an infinite baffle (wall), where the acoustic power from the rear of the speaker is totally wasted. Moreover, the bass reflex arrangement more effectively damps the speaker oscillations which would occur at the speaker resonant frequency.

In most bass reflex designs, the bass reflex port is tuned to the same resonant frequency as the loudspeaker itself. In order to so tune the enclosure, the enclosure must be relatively large if the bass reflex port is to be the same size as the speaker. It is hypothesized that having the port area the same size as the speaker cone area, radiation efficiency is maximized. However, in order for the speaker enclosure to be tuned to a low resonant frequency with a large diameter port, the speaker enclosure again must be quite large. In order to produce an enclosure of smaller size and yet maintain the improved damping characteristics and improved efficiency of the bass reflex design, it has been common to use a smaller port which is tuned to the woofer resonant frequency through the use of a tube or extension of the port which extends into the speaker enclosure.

The size of the bass reflex port, coupled with the mass of air in the extended length of the port and the speaker enclosure internal volume, allow tuning of the bass reflex design to the resonant frequency of the loudspeaker without requiring a large cabinet. Unfortunately, in this process, a significant amount of radiated energy is lost due to the smaller port size and acoustic resistance. However, such bass reflex designs are still extremely common and are capable of very good performance.

In the late 1950's or early 1960's, the so-called "acoustic resonance" or "infinite baffle" designs became popular. In these designs, efficiency is sacrificed for smoothness of response and, in particular, extended bass response. In such designs, the port of the bass reflex design is completely eliminated. Instead of choosing a woofer having a resonant frequency in the audible range of 30 to 60 Hz or thereabouts, a speaker of exceptionally low (subsonic) resonant frequency, (i.e. from 5 to 15 Hz) is selected. As with the bass reflex design, the cabinet walls of acoustic resonant type speakers are thick and non-resonant. In the case of one well known, very high end system, double enclosure walls were utilized, with the interstices filled with sand to eliminate all enclosure vibration.

There is no air flow in and out of the acoustic resonance speaker enclosure itself. The air space inside acts as an additional "air spring" which materially raises the resonant frequency of the speaker when mounted in the enclosure as compared to the free air resonance of the speaker. Thus, when mounted in the enclosure, a 10 Hz resonant loudspeaker may have a resonant frequency of from 30 to 80 Hz or higher. The principle advantage of the acoustic resonance design is that the bass response falls off at a much slower rate than the 12 dB rate normally associated with bass reflex speakers. Acoustic resonance speakers are, in general, still underdamped, however, and are usually filled or partially filled with acoustic insulation such as low density fiberglass. The fiberglass insulation dampens the standing waves which otherwise might occur in the enclosure, and also increases the effective acoustic volume due to the resistance to air flow of the acoustic insulation. Acoustic resonance designs have been very popular and are still in common use today. However, a significant drawback is the limited efficiency of such speakers.

A variety of other designs have been suggested during the years. For example U.S. Pat. No. 4,872,527 discloses the use of an enclosure having a divided partition which serves to act as a second resonant chamber. The bass port is located within this resonant chamber instead of being simply located within an uncompartmentalized loudspeaker enclosure. Enhanced bass response is said to be provided thereby. A more complicated design with several internal resonant chambers is disclosed in U.S. Pat. No. 4,482,026. Regardless of the type of enclosure, it is fundamental to acoustic design that the walls of the enclosure be very stiff and non-resonant in order to ensure that the sound generated by the speaker system is due to the loudspeakers themselves, and not do to any resonance of the enclosure. For example, in the well known treatise by Abraham B. Cohen, HI-FI LOUDSPEAKERS AND ENCLOSURES, Rev. 2d Ed., ® 1968 Hayden Book Company, Inc., pp. 290–297, the required robustness of the speaker panels is well documented. On page 292 is indicated that effect the number of screws holding the back panel of a speaker system to the enclosure has on the frequency response and distortion. Cohen indicates that the larger number of screws and therefore the lower the vibration of the back panel, the more accurate the frequency response of the loudspeaker system. See also A. Badmaieff and D. Davis, SPEAKER ENCLOSURES, Howard W. Sams & Co., New York, c1966.

Consumers have also begun to require loudspeaker systems with higher energy output. This increased energy output is due mainly to the differences in listening habits of consumers. For example, it is quite common, especially in the younger age group consumer, to raise the volume of stereo systems to near the maximum, often increasing bass boost to near the maximum at the same time. Most ordinary bass reflex systems and acoustic resonance systems simply cannot take this degree of power. The result is a burnt-out voice coil, at worst, and at best, a highly distorted output.

In order for the power output to be increased, not only for home listening, but also for use in theaters, nightclubs and the like, it has been common to employ massive arrays of very large bass loudspeakers each of which contain massive magnetic structures and very heavy voice coils. Unfortunately, the use of such large and heavy voice coils results in an inability of the speaker to accurately reproduce transients. Moreover, the very power-hungry voice coils also require very large and expensive amplifiers. It is not uncommon to enter a nightclub and see arrays of speaker system components which in the aggregate weigh several hundred pounds.

It would be desirable to provide loudspeaker systems which are capable of high power output without the use of large numbers of bass drivers. It would be further desirable to produce loudspeaker systems which have an extended frequency response range. It would yet be further desirable to produce such loudspeakers in a size which is convenient for the average consumer and which also can be used to provide the high volume of sound in nightclub performances without multiple speaker arrays.

SUMMARY OF THE INVENTION

The inventor has surprisingly and unexpectedly found that by violating the basic tenants of speaker construction, i.e. the use of thick, strong, and nonresonant walls for speaker enclosures, and by utilizing the speaker enclosure itself to provide a significant portion of the acoustic energy, a speaker system of exceptionally high power output, extended frequency range, and low distortion can be produced in a simple and cost effective manner, yet of a size useful for both at home consumer as well as theatrical and nightclub use. The speaker enclosures of the subject invention include a resonant cabinet where the walls of the cabinet contribute appreciably to the acoustic output; a sound post located between the front and rear resonant surfaces in order to couple these surfaces together acoustically; and a bass reflex port of smaller diameter than the bass loudspeaker cone itself, coupled with acoustic coupling of the port to maximize sound velocity through the port.

By the term "resonant enclosure" is meant that the thickness and nature of the materials of construction are such that the enclosure walls themselves, particularly the front and back panels, contribute significantly to the output. This term is in contradistinction to the thick and substantially non-resonant walls traditionally utilized, as taught, e.g. by Cohen.

DETAILED DESCRIPTION OF THE PREFERRED EMBODIMENTS

Figure 3A:
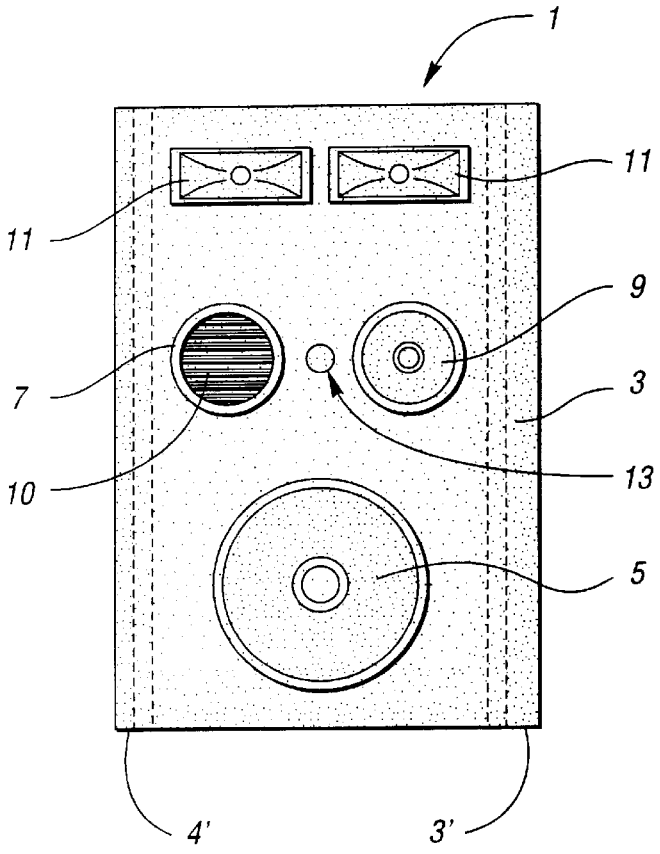
FIG. 3*a* illustrates a frontal drawing of a loudspeaker system according to one embodiment of the subject invention.

The loudspeaker system of the present invention may be described with reference to FIG. 3*a* to 3*c*. In FIG. 3*a*, the loudspeaker enclosure 1 has a first surface 3 containing at least two holes, one adapted to the mounting of a bass electrodynamic transducer (woofer) 5 and at least a second opening 7 which constitutes a bass diffraction port. As shown in FIG. 3*a*, the speaker enclosure face 3 may also contain openings for a mid-range 9 and/or tweeter(s) 11. More than one woofer, mid-range, or tweeter may be used as desired, or composite mid/tweeters may be used. The enclosure may be constructed without midrange/tweeters or other higher frequency generating components, thus serving only to produce the low frequencies. The location of the bass diffraction port is not overly critical, however it is not preferably located immediately adjacent the woofer. Most preferably, it is located a distance away from the woofer which corresponds at least to the woofer radius.

The areal dimensions of the bass diffraction port, the length of the port, and the total acoustic resistance of the port should be such that the port is preferably tuned to a frequency slightly less than the speaker resonant frequency when the speaker is mounted in the enclosure. As indicated in Badmaieff at page 57, however, the port may be purposefully tuned to higher or lower resonant frequencies to adjust bass response appropriately. In general, the port resonant frequency should be within one octave of the speaker resonant frequency.

A necessary component of the speaker enclosure is a sound post 13 which connects the front panel of the speaker enclosure with the rear panel. The sound post is sufficiently robust to effectively couple the front speaker panel with the rear panel. For example, with a speaker enclosure of nominal size as preferred herein, the sound post diameter may advantageously range from 0.375 inch to 1.25 inches, preferably 0.4375 inch to 1:0 inch. The sound post may be square or rectangular in addition to circular in cross-section. The sound post should be securely fastened to the front and rear speaker panels, for example by screws, bolts, or other fasteners, and/or through the use of suitable adhesives. The post may also be seen in FIGS. 3*b* and 3*c*.

Optionally shown in FIG. 3*a* is an acoustic coupling grill device 10. Preferably, the acoustic coupling grill device decreases the area of the port by minimally 20%. This device provides a restriction of the areal dimensions of the port which increases the air velocity through the port and improves acoustic coupling with air outside of the enclosure. It may be a simple grid-like design, a series of parallel ribs, or a diffraction plate. Most preferably, the acoustic coupling grill device comprises a grid-like structure of parallel slots, such as are available as plastic floor drain covers. A second optional element aids in causing the lower frequencies to diffract around the inside edge of the port, while at the same time attenuating higher frequencies. As shown in FIG. 3*b* at 8, this element preferably comprises a ring of polymer foam, for example, a polyurethane foam such as that commonly used for weatherstripping. The foam absorbs high frequencies which would tend to reflect from the lip of the bass diffraction port.

Figure 3C:
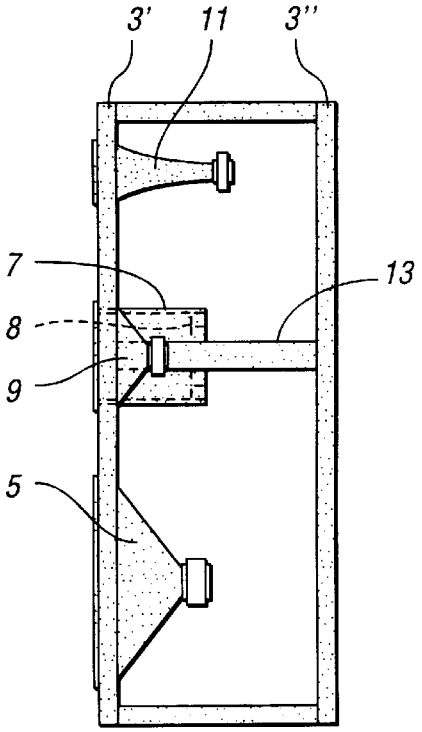
FIG. 3*c* illustrates a side view of the loudspeaker system of FIG. 3*a*.
Figure 3B:
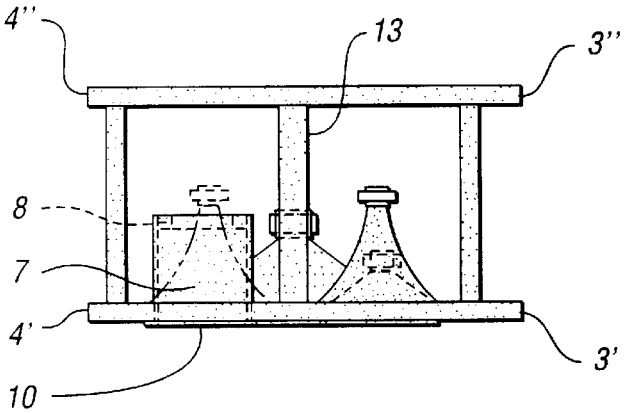
FIG. 3*b* illustrates a top view of the loudspeaker system of FIG. 3*a*.

FIG. 3*b* is a top view of the enclosure of FIG. 3*a*. From the top, the length of the bass diffraction port 7 may be seen. The extension of the port into the cabinet interior is generally necessary in order to tune the port to the selected resonant frequency. The smaller the areal dimensions of the port, the longer the port length must be to achieve a given resonant frequency. These adjustments are routine, and are described, for example, in Cohn and Badmaieff. With a 12 inch speaker having a free air resonance of c.a. 22 hz, and a resonance of c.a. 91 hz when mounted in the enclosure, a port of 4 inch diameter, 5 inches in length has been found desirable. Such a port will provide a port resonant frequency of c.a. 61 hz.

It has been surprisingly found that cabinet asymmetry with respect to the dimensions of the front and/or rear speaker panels relative to the overall enclosure dimensions has a substantial effect on speaker output quality. For example, as shown in FIG. 3*b*, the front and back panels preferably do not coincide with the outside dimensions of the enclosure per se, but extend beyond the enclosure at 3' and 3". Alternatively, one set of edges may extend beyond the cabinet as shown (3',3") while opposing edges, shown at 4' and 4", extend a different amount.

If the edges (e.g., 3' and 4') extend the same amount, then the sound quality may suffer somewhat. However, if the edges extend in an asymmetric fashion, a noticeable difference in sound quality will be evident. While not wishing to be bound to any particular theory, it is believed that the asymmetry affects the allowed vibrational modes of the various panels. The asymmetry created by differing extensions of one side of the front and back panels as opposed to the other side of the front and back panels is believed to assist in eliminating or reducing the principle vibration resonant peak or peaks which would otherwise be associated with a panel of the same dimensions (e.g., as defined by the height and by the width from one side 6 to the other side 12, distributing the vibrational modes across a range of frequencies rather than a dominate primary frequency. Most preferably, the front and back panels are flush with the cabinet on one side, but extend beyond the cabinet on the other side. The top and bottom edges of the front and back panels may also extend beyond the cabinet per se, but this is not necessary, and not preferred. It is preferred that a minimal amount of acoustic insulation material, e.g., a layer of 0.75 inch to one inch thick dacron batting be applied to the inside surface of the back of enclosure.

With respect to FIG. 3*c*, the bass reflex port extension 8, sound post 13, mid-range 9 and tweeter 11 may be seen. The design embodied in FIGS. 3*a*–3*b* is a preferred embodiment of the subject invention, but the subject invention is not limited thereto.

Figure 1:
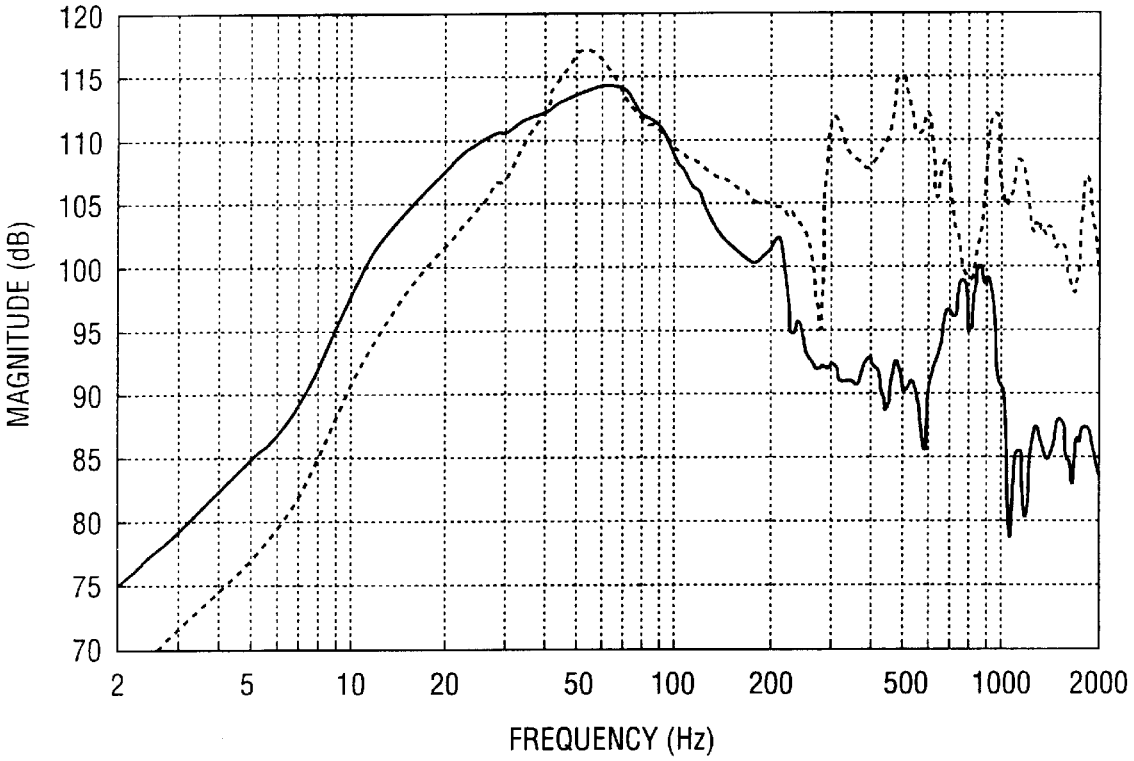
FIG. 1 discloses the port (dashed line) frequency response curve for a conventional commercial loudspeaker enclosure and one embodiment of an enclosure of the present invention (solid line).

FIG. 1 illustrates the port frequency response of a loudspeaker according to the present invention (solid line) and a commercial bass reflex-type PA speaker as might be used by a band. As can be seen by comparing the two response curves, both ports have their highest acoustic output at c.a. 60 hz. The resonance peak of the speaker in accordance with the subject invention is rather broad, and the frequency response is down 10 dB at approximately 15 hz, a very low frequency. The commercial speaker is down 10 dB at 30 hz, and at 15 hz is down 20 dB. The subject invention speaker exhibits much smoother and more extended bass response.

In terms of mid-range response emanating from the port, the speaker of the present invention is, on average, greater than 20 dB down over the frequency range of 300 hz to 2000 hz, indicating that the design is effective to block the mid-range frequencies from the port emission. The majority of mid-range power will be generated by the front of the speaker cones, which is most desirable. The commercial speaker, on the other hand, is only down about 10 dB in the 300 hz to 2000 hz range, and indeed has numerous peaks which demonstrate a power level similar to that of the bass resonant frequency. In particular, the peak at 500 hz is only down from the 60 hz resonant frequency by about 2.5 dB. Significant mid-range radiation thus issues through the bass port.

Figure 2:
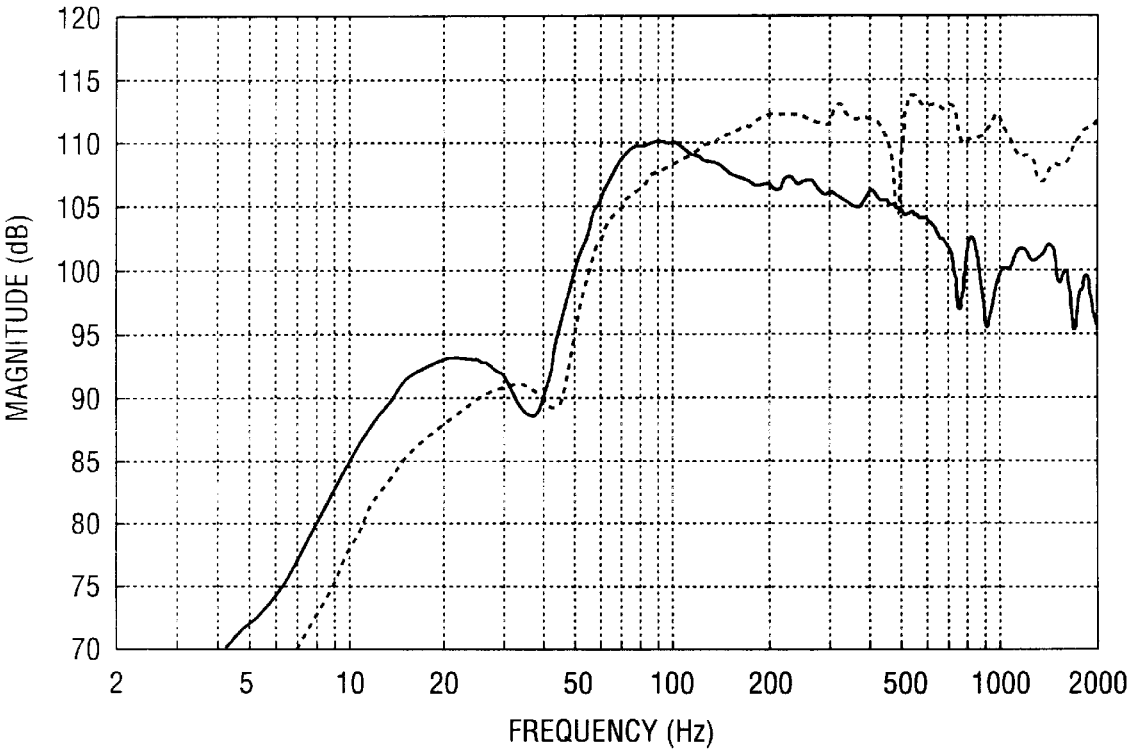
FIG. 2 illustrates a frequency response curve for the woofer output of a loudspeaker enclosure of a conventional commercial loudspeaker enclosure (dashed line) and a loudspeaker enclosure according to the subject invention (solid line).

FIG. 2 illustrates the woofer output of the speaker systems of FIG. 1. As can be seen, the subject invention speaker (solid line) has an output at the lowest frequency resonance peak of 93 dB centered at about 22 hz, while the commercial speaker output (same driving force, 1.0 v RMS) has a peak output of 91 dB, but centered at 33 hz. At the frequency of the resonant peak of the subject invention speaker, 22 hz, the commercial speaker has an output of 88 dB, down approximately 5 dB in response.

Between them, FIGS. 1 and 2 illustrate that the bass response of the loudspeaker system of the present invention is both smoother and more extended than the commercial speaker. When the combined port/woofer outputs are considered, the inventive speaker displays a 10 hz improvement in low frequency response, being 10 dB down at about 35 hz, while the commercial speaker is 10 dB down at about 45 hz, the reference loudness levels being the average acoustic output over the range of 200 hz to 2000 hz. The subject invention loudspeaker also demonstrates about 5 dB increase in output over the critical 50 hz to 100 hz region.

Having generally described this invention, a further understanding can be obtained by reference to certain specific examples which are provided herein for purposes of illustration only and are not intended to be limiting unless otherwise specified.

A loudspeaker in accordance with the subject invention was prepared by standard cabinet construction techniques, substantially in accordance with FIGS. 3*a*–3*c*. The cabinet, devoid of side extension, measured 30.25 inches tall by 16 inches wide by 9 inches deep, these being the exterior dimensions. The front and back panels were 17 inches wide, thus providing a one inch overlap 3' and 3", as shown in FIG. 3*b*. All panels except the bottom are ½ inch standard grade plywood, the bottom being ¾ inch plywood. The sides, front, back, top, and bottom are glued to each other using standard white carpenters glue, assisted by screws at intervals of approximately 7 inches.

A 12 inch woofer is mounted centered on the front surface equidistant from each side of the enclosure, with its center approximately 8 inches from the enclosure bottom. A 4 inch port, approximately 5 inches long, is located approximately 13.5 inches from the woofer center, and to one side of the cabinet so as to allow for the presence of an 8 inch mid-range alongside. The port has a 4 inch plastic grating (basement drain grating) mounted on its exterior, and has one inch of acoustic foam insulation in the form of a ring along the part inner circumference at its interior end. Located toward the top of the cabinet are two horn-type tweeters. The speaker components used are as follows: Woofer—Swan#305; Mid-range—Eminence #W0838R; Tweeters—Motorola high power horns, connected in series. A sound post comprising a one inch wooden dowel is mounted between the front of the enclosure and the rear of the cabinet. The sound post is secured to the cabinet front and rear by wood screws. The interior volume of the enclosure is approximately 2.15 cubic feet.

Having now fully described the invention, it will be apparent to one of ordinary skill in the art that many changes and modifications can be made thereto without departing from the spirit or scope of the invention as set forth herein.

What is claimed is:

1. A loudspeaker system having extended bass response, comprising:

a generally rectilinear resonant enclosure having front and back surfaces, a first side surface and a second side surface, and top and bottom surfaces;

said front surface having located therein an electrodynamic low frequency loudspeaker, the front surface of said low frequency loudspeaker communicating with the surrounding atmosphere exterior to the enclosure;

a tuned bass diffraction port in communication with the front surface, said tuned diffraction port having an area not more than one-half the effective area of the front surface of said low frequency loudspeaker;

a low pass filter located in said tuned port; and a sound post connecting said front surface to said back surface.

2. The loudspeaker system of claim 1 wherein edges of said front and back surfaces extend unequally beyond said first side surface and said second side surface.

3. The loudspeaker system of claim 2 wherein edges of said front and back surfaces are flush with a first side of said enclosure but extend beyond a second side of said enclosure.

4. The loudspeaker system of claim 1 wherein said tuned port terminates at the enclosure exterior in an acoustic coupling grill device, said acoustic coupling grill device effective to decrease the area of the port by minimally 20%.

5. The loudspeaker system of claim 4 wherein said acoustic coupling grill device comprises a plurality of parallel slots.

6. The loudspeaker system of claim 1 wherein said electrodynamic low frequency loudspeaker comprises a woofer having a nominal diameter of 12 inches, and the tuned bass diffraction port has an area of about 10 square inches to about 27 square inches.

7. The loudspeaker system of claim 6 wherein the interior volume of said enclosure is from about 1.5 $ft^3$ to about 4 $ft^3$.

8. The loudspeaker system of claim 6 wherein said front surface and said back surface comprise a laminated wood product having a thickness ranging from 0.375 inch to 0.625 inch.

9. The loudspeaker system of claim 1 further comprising one or more mid-range speakers and one or more tweeters.

10. The loudspeaker system of claim 7 wherein at least one of said front and back surfaces overlaps a first side of said enclosure by from about 0.5 inch to about 3 inches.

11. The loudspeaker system of claim 1 wherein said tuned bass diffraction port comprises a cylinder open at both ends, an inner end located within said enclosure, said inner end having a ring of acoustic insulation located around the inner circumference of said cylinder, said acoustic insulation effective to attenuate mid-range frequencies traversing said bass diffraction port.

12. The loudspeaker of claim 11 wherein said ring of acoustic insulation comprises a ring of polymer foam.

13. A loudspeaker system, comprising:

a generally rectilinear, resonant enclosure having front and back surfaces, a first side surface and a second side surface, and top and bottom surfaces, the interior volume of said enclosure being between 1.5 cubic feet and 4 cubic feet;

said front surface having located therein an electrodynamic low frequency loudspeaker, the front surface of said loudspeaker communicating with the surrounding atmosphere exterior to said enclosure;

a tuned bass diffraction port in communication with said front surface, said tuned bass diffraction port tuned to a frequency equal to or less than the resonant frequency of said low frequency loudspeaker when mounted in said enclosure; said bass diffraction port having, at an outer end of said port in communication with the atmosphere exterior to said enclosure, an acoustic coupling grill device which reduces the area of the port by at least 20%; said bass diffraction port having at an inner end in communication with the interior of said enclosure a low pass filter comprising a ring of acoustic insulation positioned within the interior of said port adjacent said inner end of said port;

a sound post coupling said front surface to said rear surface.

* * * * *